US005969694A

United States Patent [19]

Harada et al.

[11] Patent Number: 5,969,694

[45] Date of Patent: Oct. 19, 1999

[54] TELESCOPIC ROD ANTENNA AND METHOD FOR MANUFACTURING THE SAME

[75] Inventors: Jiro Harada; Shinichi Saito, both of Tokyo; Misao Kimura, Yokosuka, all of Japan

[73] Assignee: Harada Industry Co., Ltd., Tokyo, Japan

[21] Appl. No.: 09/037,389

[22] Filed: Mar. 10, 1998

[30] Foreign Application Priority Data

Dec. 19, 1997 [JP] Japan ..... 9-351321
Dec. 25, 1997 [JP] Japan ..... 9-358501

[51] Int. Cl.[6] ..... H01Q 1/10

[52] U.S. Cl. ..... 343/901; 343/740

[58] Field of Search ..... 343/901, 900, 343/903, 790, 791, 792

[56] References Cited

U.S. PATENT DOCUMENTS 4,331,339 5/1982 Reinsma ..... 277/84
5,072,230 12/1991 Taniyoshi et al ..... 343/903
5,079,562 1/1992 Yarsunas et al. ..... 343/903
5,189,435 2/1993 Yarsunas et al. ..... 343/903

*Primary Examiner*—Don Wong
*Assistant Examiner*—James Clinger
*Attorney, Agent, or Firm*—Koda & Androlia

[57] ABSTRACT

A telescopic rod antenna according to the present invention includes an antenna element and a waterproof ring-shaped seal member which is inserted in a ring-shaped gap in a joint between two rods of the antenna element. The ring-shaped seal member is obtained by shaping a thermoplastic resin film strip, on which at least one projecting portion is formed in its longitudinal direction, like a ring and compressing and inserting a ring-shaped film into the ring-shaped gap. A plurality of ring-shaped contact portions are formed on both sides of the film strip in its longitudinal direction while the projecting portion of the film strip serves as a basic contact portion. The ring-shaped contact portions are adhered to the inner surface of the larger-diameter rod and the outer surface of the smaller-diameter rod at a predetermined pressure. The tip portion of the smallest-diameter rod is provided with a short cylinder member fitted to the outer periphery of the tip portion of the smallest-diameter rod, and a stopper member for sealing an open end of a hollow of the short cylinder member.

6 Claims, 6 Drawing Sheets

TELESCOPIC ROD ANTENNA AND METHOD FOR MANUFACTURING THE SAME

BACKGROUND OF THE INVENTION

The present invention relates to a telescopic rod antenna and a method for manufacturing the same and, more particularly, to a telescopic rod antenna having a waterproof means for preventing rainwater or the like from soaking into an antenna element through a gap in a joint between a smaller-diameter rod and a larger-diameter rod.

As illustrated in FIG. 14, a prior art telescopic rod antenna generally includes an antenna element 80 constituted by slidably coupling a plurality of rods 81, 82 and 83 of conductive tubes formed of, e.g., brass and having different diameters (three rods are used in this prior art case). The antenna element 80 is insertably held in an antenna element holding tube 90. A certain waterproof means is provided at a joint or a coupling portion X between rods of the antenna element 80.

FIG. 15 is a partly cutaway enlarged sectional view showing the coupling portion X of FIG. 14. In FIG. 15, for example, Ra indicates a smaller-diameter rod corresponding to the rod 81 and Rb represents a larger-diameter rod corresponding to the rod 82.

Referring to FIG. 15, a ring-shaped recess is formed by cutting the inner surface of the larger-diameter rod Rb at the coupling portion X. First and second collars 101 and 102 each shaped like a ring are fitted into the recess, and an O-shaped ring 103 formed of highly elastic member or the like is interposed between the collars 101 and 102. An opening of the tip portion of the larger-diameter rod Rb is constituted as an end-narrowed portion 104 which is narrowed axially by the narrowing process.

In the telescopic rod antenna having the above constitution, as indicated by the broken lines in FIG. 15, water W such as rainwater will soak into the antenna element 80 through a gap between the outer surface of the smaller-diameter rod Ra and the end-narrowed portion 104 at the tip of the larger-diameter rod Rb. Since, however, the water W is blocked with the O-shaped ring 103 which is mounted fluid-tightly between the outer surface of the smaller-diameter rod Ra and the inner surface of the larger-diameter rod Rb, it does not soak below the O-shaped ring 103.

In an antenna element the rods of which are formed of stainless steel, the above-described cutting process is hardly performed since the stainless steel is hard and the rods are formed relatively thin, and usually an O-shaped ring is supported only by narrowing the tip portion of each rod.

FIG. 16 is a partly cutaway enlarged sectional view of an example of a coupling portion X of the stainless steel rods described above. In this example, a ring-shaped swelling portion 105, which is swelled outward by the narrowing process, is formed on the inner wall of the open end portion of the larger-diameter rod Rb, and an O-shaped ring 103 is held in a recess formed in the inner surface of the ring-shaped swelling portion 105.

The foregoing prior art telescopic rod antenna has the following drawbacks.

In the brass rod antenna as shown in FIG. 15, since the inner surface of the larger-diameter rod Rb has to be cut, the manufacturing steps are increased and so are the manufacturing costs. The fluid-tightness between the smaller- and larger-diameter rods Ra and Rb is lost in a relatively short time by variations in the inside and outside diameters of the rods Ra and Rb, wear due to sliding between the O-shaped ring 103 and the smaller-diameter rod Ra, and the like. Therefore, a waterproof function cannot be maintained satisfactorily for a long period of time.

In the stainless steel rod antenna as shown in FIG. 16, since the material of the rods is hard, there occurs no decrease in fluid-tightness due to wear, unlike in the brass rod antenna shown in FIG. 15. In this antenna, the inner surface of the larger-diameter rod Rb need not be cut but the ring-shaped swelling portion 105 has to be formed and the O-shaped ring 103 is fitted into the recess formed in the inner surface of the ring-shaped swelling portion 105. Consequently, there is no great difference in number of manufacturing steps between the rod antennas shown in FIGS. 15 and 16, and the manufacturing cost are increased inevitably.

As described above, conventionally, a relatively expensive O-shaped ring, which is formed of a highly elastic member or the like, is required as a waterproof element to be provided at a joint or a coupling portion X between rods, and any special processing is applied to the rods in order to stably fit the O-shaped ring into a recess. Since there is a case where the waterproof function is not fulfilled completely only by the O-shaped ring 103, grease for sealing or the like is used to make the waterproof function perfect, resulting in increasing in manufacturing steps and manufacturing costs.

Of the rods constituting the antenna element 80, the smallest-diameter rod 81 is provided with a so-called top portion 85 at the tip portion thereof. More specifically, the top portion 85 is attached to the rod 81 in such a manner that a columnar portion 85*a* projected from the lower end of the top portion 85 is compressed into a hollow of the tip portion of the rod 81 and then the outer circumference of the tip portion of the rod 81 is caulked with rings. In FIG. 14, reference numeral 86 indicates a ring caulking portion. The ring caulking causes some irregularities or distortion on the outer surface of the smallest-diameter rod 81. If the irregularities or distortion is relatively great, the rod 81 is not held smoothly into the subsequent rod 82, and a gap due to the irregularities or distortion occurs between the outer surface of the rod 81 and the inner surface of the rod 82 when the antenna element is retracted. It is thus likely that rainwater or the like will soak into the antenna element through the gap.

BRIEF SUMMARY OF THE INVENTION

Accordingly, an object of the present invention is to provide a telescopic rod antenna having a waterproof means which is capable of maintaining a waterproof function stably, satisfactorily for a long period of time and which requires no special processing for rods and thus decreases in manufacturing steps and constituting elements, thereby lowering manufacturing costs.

To achieve the above object, according to the present invention, there is provided a telescopic rod antenna having the following constructions and a method for manufacturing the same. The other characteristic constructions will be described later in the embodiment of the present invention.

According to a first aspect of the present invention, there is provided a telescopic rod antenna comprising:

an antenna element including a plurality of rods slidably coupled to each other, the plurality of rods having different diameters and each being formed of a conductive tube member; and a ring-shaped seal member provided in a ring-shaped gap in a joint between a smaller-diameter rod and a larger-diameter rod of the antenna element, for preventing water from soaking into the rods from outside, wherein the ring-shaped seal member is obtained by shaping a thermoplastic resin film strip like a ring, the film strip having at least one projecting portion along a longitudinal direction thereof, and compressing and inserting a ring-shaped film into the ring-shaped gap, adhering a plurality of ring-shaped contact portions, formed along a longitudinal direction on both sides of the ring-shaped film, to an inner surface of the larger-diameter rod and an outer surface of the smaller-diameter rod at a predetermined pressure while the projecting portion of the film strip serves as a basic contact portion, and fluid-tightly sealing a gap between the outer surface of the smaller-diameter rod and the inner surface of the larger-diameter rod.

According to a second aspect of the present invention, there is provided a telescopic rod antenna comprising:

an antenna element including a plurality of rods slidably coupled to each other, the plurality of rods having different diameters and each being formed of a conductive tube member;

a top portion provided at a tip portion of a smallest-diameter rod of the antenna element, and including both a short cylinder member, which is fitted to the outer periphery of a small-diameter portion formed in advance at the tip portion of the smallest-diameter rod and a stopper member inserted and fixed into an open end of a hollow of the short cylinder member such that the open end is sealed at the tip portion of the smallest-diameter rod; and a ring-shaped seal member provided in a ring-shaped gap in a joint between a smaller-diameter rod and a larger-diameter rod of the antenna element, for preventing water from soaking into the rods from outside, wherein the ring-shaped seal member is obtained by shaping a thermoplastic resin film strip like a ring, the film strip having at least one projecting portion along a longitudinal direction thereof, and compressing and inserting a ring-shaped film into the ring-shaped gap, adhering a plurality of ring-shaped contact portions, formed along a longitudinal direction on both sides of the ring-shaped film, to an inner surface of the larger-diameter rod and an outer surface of the smaller-diameter rod at a predetermined pressure while the projecting portion of the film strip serves as a basic contact portion, and fluid-tightly sealing a gap between the outer surface of the smaller-diameter rod and the inner surface of the larger-diameter rod.

According to a third aspect of the present invention, there is provided a method for manufacturing a telescopic rod antenna, comprising:

a step of obtaining a thermoplastic resin film strip having a preset measurement, on which at least one projecting portion is formed along a longitudinal direction of the film strip;

a step of shaping the film strip like a ring and inserting a ring-shaped film into a larger-diameter rod from an opening at a distal end portion thereof;

a step of inserting a smaller-diameter rod into the larger-diameter rod from the opening of the distal end portion of the larger-diameter rod; and a step of pulling the smaller-diameter rod out of an opening at a tip portion of the larger-diameter rod and compressing the film strip in a ring-shaped gap in a joint between the smaller-diameter rod and the larger-diameter rod in an axial direction of the rods;

wherein the film strip is curved in a width direction thereof in a plurality of regions into which the film strip is divided by the projecting portion, both end portions of the film strip are brought into contact with each other, and a plurality of ring-shaped contact portions, which are formed along a longitudinal direction on both sides of the film strip, are adhered to an inner surface of the larger-diameter rod and an outer surface of the smaller-diameter rod at a predetermined pressure while the projecting portion serves as a basic contact portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (Embodiment)

Figure 1:
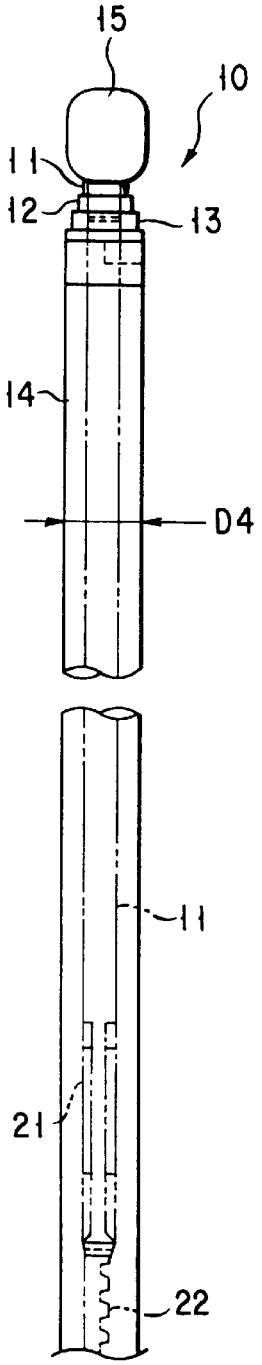
FIG. 1 is a side view schematically showing a telescopic rod antenna according to an embodiment of the present invention when an antenna element is retracted.
Figure 2:
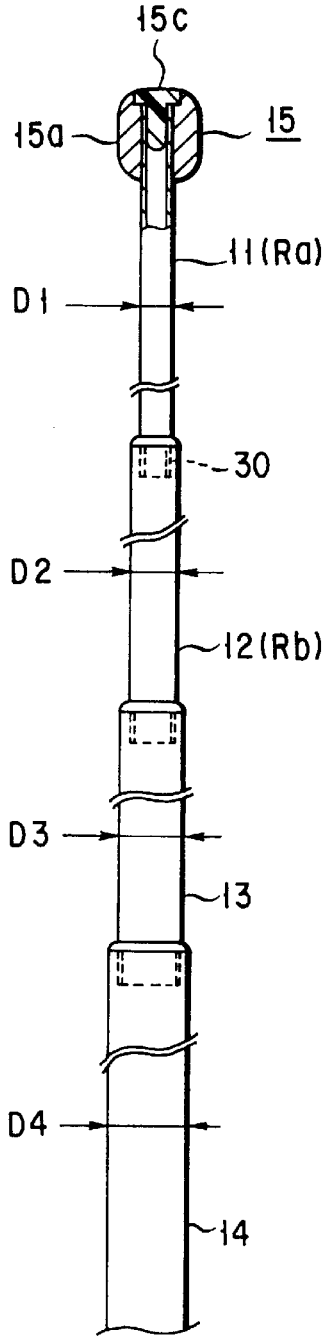
FIG. 2 is a side view schematically showing a telescopic rod antenna according to the embodiment of the present invention when the antenna element is extended.

As illustrated in FIGS. 1 and 2, a telescopic rod antenna according to an embodiment of the present invention, includes a telescopic antenna element 10 constituted by slidably coupling a plurality of rods 11 to 14 (four in this embodiment) of conductive tube members. The rods 11, 12, 13 and 14 have their respective outside diameters D1, D2, D3 and D4 increasing in this order.

The antenna element 10 is held insertably in a holding tube (not shown). As illustrated in FIG. 1, a driving rope 22 is connected to the distal end portion of the smallest-diameter rod 11 via a joint 21. If the rod 11 is protruded from another rod by transferring the driving rope 22 in the longitudinal direction of the antenna element 10, the rod follows the smallest-diameter rod 11, and the antenna element 10 is extended. If the rod 11 is retracted into another rod, the latter rod follows the rod 11 and the antenna element 10 is retracted.

Figure 3:
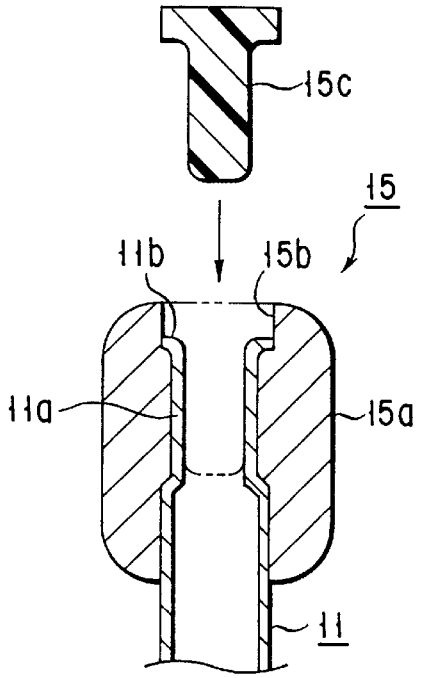
FIG. 3 is an exploded cross-sectional view illustrating the constitution of a top portion of the telescopic rod antenna according to the embodiment of the present invention.

As illustrated in FIGS. 1 and 2, a roundish top portion 15 is attached to the tip portion of the smallest-diameter rod 11 of the telescopic antenna element 10. As shown in detail in FIG. 3, a small-diameter portion 11*a* is formed in advance at the tip portion of the rod 11, and a metallic, short cylinder member 15*a* is fixed to the outer periphery of the small-diameter portion 11*a*. Then, a stopper member 15*c*, which is made of, e.g., resin, is pressed and fixed (or bonded) into an open end 15*b* of a hollow of the short cylinder member 15*a* and the tip portion of the rod 11 in the direction of an arrow such that the open end is sealed at the tip portion of the rod 11.

In order to prevent the short cylinder member 15*a* from coming out of the small-diameter portion 11*a*, an opening 11*b* at the tip portion of the smallest-diameter rod 11 is expanded at the open end 15*b* by a pressure means such as a press mechanism. This expansion processing is executed locally only for the opening 11*b* of the rod 11. Thus, irregularities or distortion, which has conventionally been caused by ring caulking, does not appear at the tip portion of the rod 11.

It is thus unlikely that a gap will be formed between the smallest-diameter rod 11 and its subsequent rod 12 by irregularities or distortion; therefore, rainwater or the like can be prevented from soaking into the rods.

Returning to FIG. 2, a ring-shaped seal member 30, which is made of thermoplastic resin (e.g., ethylene tetrafluoride resin), is inserted in a ring-shaped gap at a joint between the smaller-diameter rod (Ra) and its subsequent larger-diameter rod (Rb) of the antenna element 10. Specifically, the ring-shaped seal member 30 is inserted in a ring-shaped gap at each of joints between the smallest-diameter rod 11 (Ra) and the second rod 12 (Rb), between the second rod 12 (Ra) and the third rod 13 (Rb), and between the third rod 13 (Ra) and the largest-diameter rod 14 (Rb). As will be described later, the ring-shaped seal member 30 is obtained from a film strip 31 of thermoplastic resin and has a shape as shown in FIG. 4.

Figure 4:
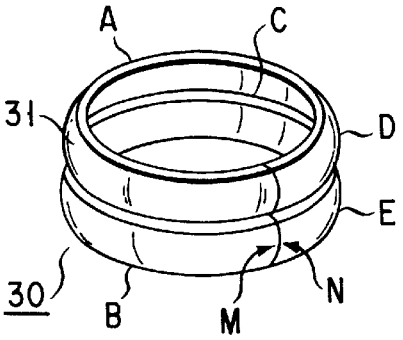
FIG. 4 is a perspective view of the constitution of a ring-shaped seal member of the telescopic rod antenna according to the embodiment of the present invention.

Referring to FIG. 4, the ring-shaped seal member 30 is so formed that the film strip 31 is divided into two regions by the centerline in its longitudinal direction, each of the regions is curved in its width direction, and both end portions M and N of the film strip 31 are compressed and connected to each other. A plurality of ring-shaped contact portions A to E are formed on both sides of the film strip 31 such that they can be adhered to the outer surface of the smaller-diameter rod Ra and the inner surface of the larger-diameter rod Rb at a predetermined pressure. A gap between the outer surface of the smaller-diameter rod Ra and the inner surface of the larger-diameter rod Rb is sealed with the ring-shaped contact portions A to E fluid-tightly several times. It is thus possible to prevent rainwater or the like from soaking into the antenna element 10 through the gap.

Figure 5:
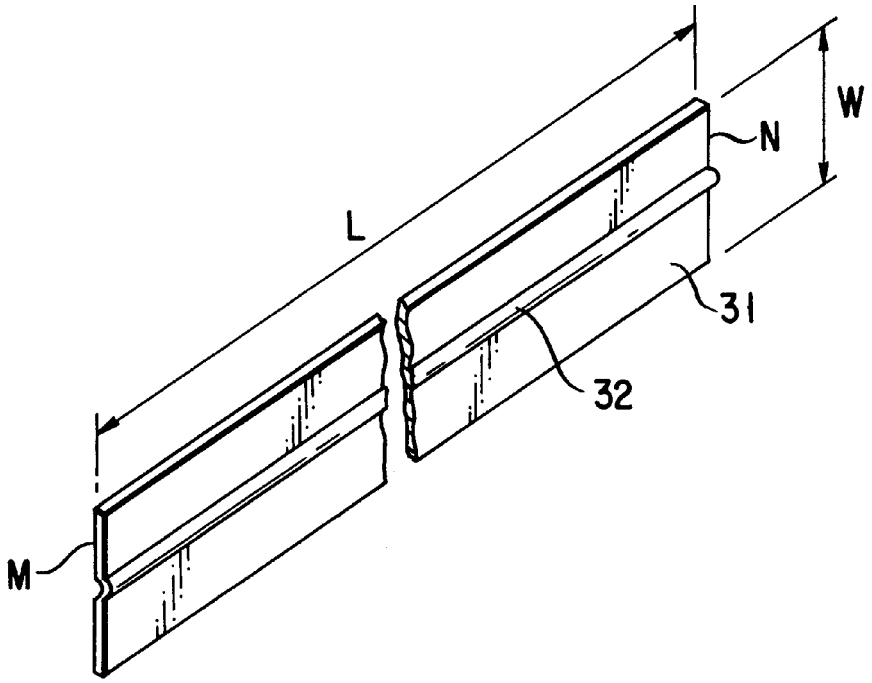
FIG. 5 is a perspective view showing a film strip as a material for constituting the ring-shaped seal member of the telescopic rod antenna according to the embodiment of the present invention.

FIG. 5 is a perspective view illustrating a material (a film strip made of ethylene tetrafluoride resin) for constituting the ring-shaped seal member 30. The film strip 31 is obtained by cutting a long, banded ribbon of ethylene tetrafluoride resin (not shown) having a width W to a predetermined length L. The film strip 31 has a projecting portion (a wavy curved portion) 32 formed along the centerline in its longitudinal direction. The projecting portion 32 is shaped in advance when the ethylene tetrafluoride resin ribbon (not shown) is made.

Figure 6:
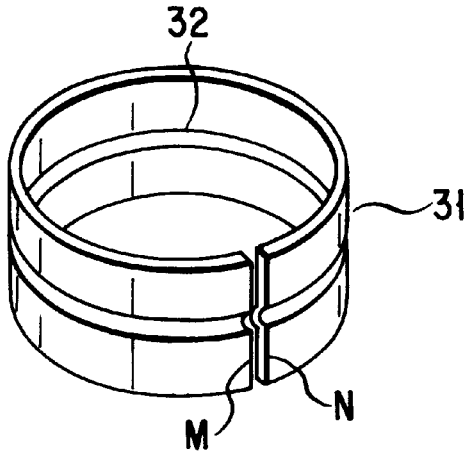
FIG. 6 is a perspective view showing a ring-shaped film as a material for constituting the ring-shaped seal member of the telescopic rod antenna according to the embodiment of the present invention.

In order to insert the film strip 31 into the ring-shaped gap V (shown in FIG. 7) in a joint between the rods, it is shaped like a ring so as to connect both end portions M and N of the film strip 31 to each other as shown in FIG. 6. The ring-shaped film so formed is inserted into the larger-diameter rod Rb as described below. It was confirmed by the inventors' experiment that the insertion of the film could easily be performed using a simple operating tool and so could be its automation. The length L of the film strip 31 is set substantially equal to the length of the inner circumference of the larger-diameter rod Rb, and the thickness and the other measurements thereof are determined such that the ring-shaped film is brought into close contact with the inner surface of the larger-diameter rod Rb when the ring-shaped film is inserted into the larger-diameter rod Rb.

Figure 7:
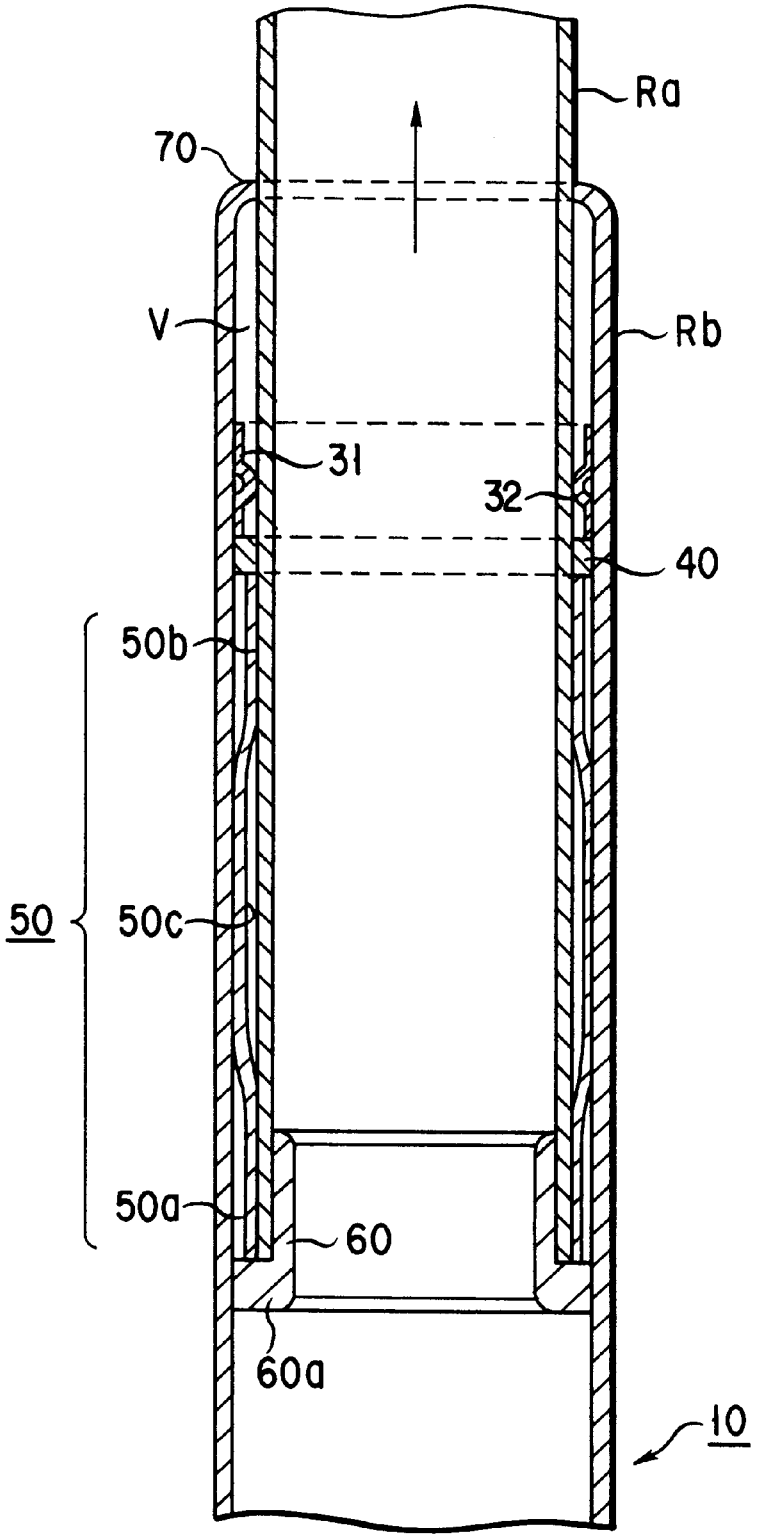
FIG. 7 is a cross-sectional view of a rod coupling portion at the beginning of the assembly of the antenna element of the telescopic rod antenna according to the embodiment of the present invention.

FIG. 7 is a cross-sectional view of a rod coupling portion at the beginning of the assembly of the antenna element 10. When the antenna element is assembled, the film strip 31 is shaped like a ring and inserted into the larger-diameter rod Rb from the opening at the distal end portion of the rod Rb (from below in FIG. 7). It is then preferable that the projecting portion 32 contact the outer surface of the smaller-diameter rod Ra. After that, a ring-shaped collar 40 is inserted into the larger-diameter rod Rb from below (in FIG. 7) and then the smaller-diameter rod Ra is inserted.

After the above operation is finished, as indicated by the arrow in FIG. 7, the tip portion of the smaller-diameter rod Ra is pulled up toward the opening at the tip portion of the rod Rb from an end-narrowed portion 70 of the larger-diameter rod Rb. Thus, the collar 40 is raised at the tip portion 50*b* of a holding spring 50 serving as a rod coupling element fixed to the distal end portion (lower part in FIG. 7) of the smaller-diameter rod Ra. The film strip 31 is moved above as it is in the larger-diameter rod Rb by the collar 40. When the film strip 31 is bumped against the inside of the end-narrowed portion 70, it stops.

The holding spring 50 can be slid such that its distal end portion 50*a* and tip portion 50*b* are fixed to the distal end portion of the smaller-diameter rod Ra and its middle portion 50*c* is pressed on the inner surface of the larger-diameter rod Rb by a predetermined pressure. Thus, the relative positions of the rods, which have been slid, are held in a mechanically stable state by the pressure of the holding spring 50. In FIG. 7, reference numeral 60 denotes a well-known stopper, which is fixed to the opening or the distal end portion (an opening at the lower end portion in FIG. 7) of the smaller-diameter rod Ra, for preventing a rod from coming out of another one, and its flange portion 60*a* supports the distal end portion 50*a* of the holding spring 50.

Figure 8:
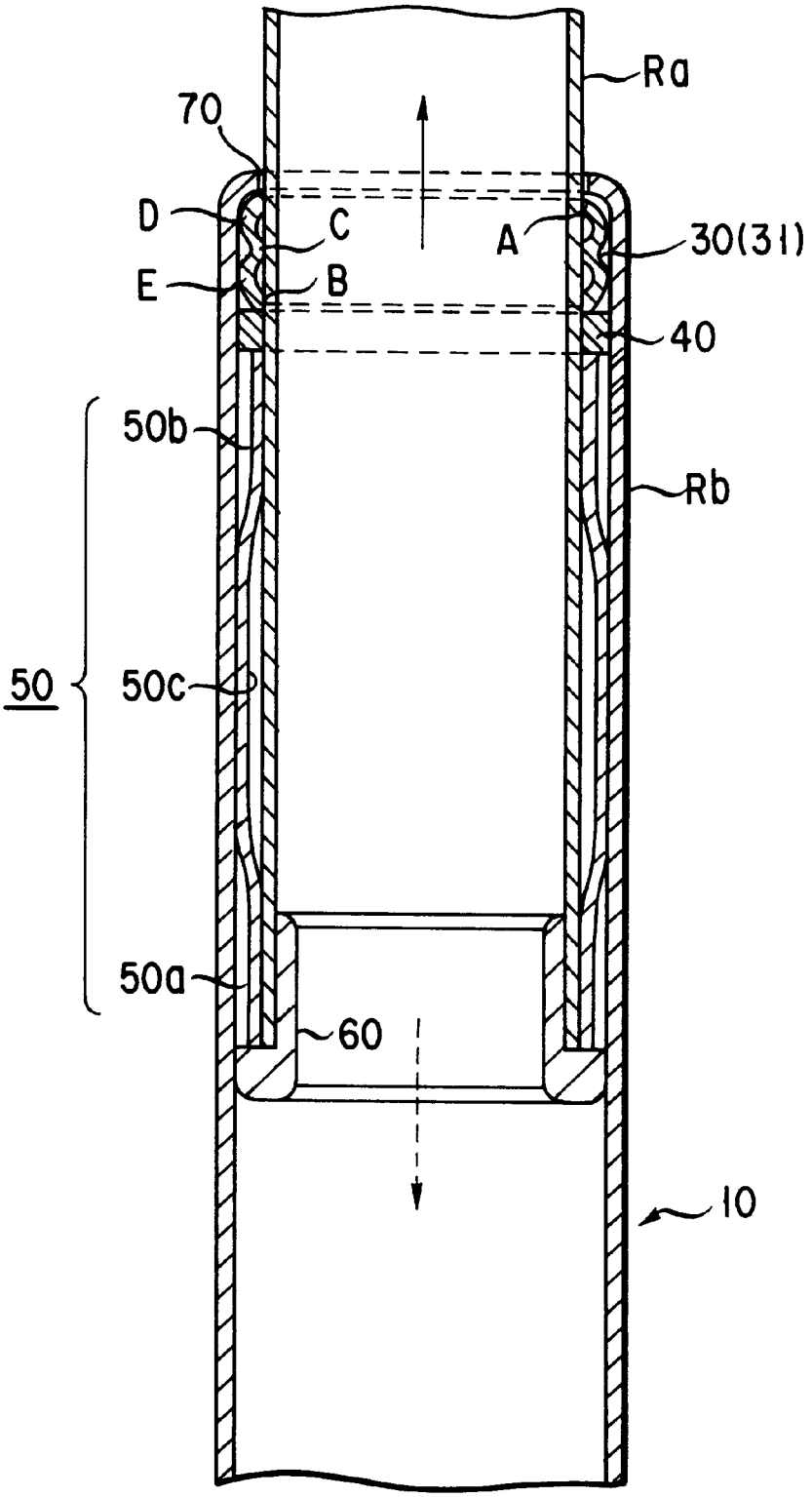
FIG. 8 is a cross-sectional view of the rod coupling portion at the end of the assembly of the antenna element of the telescopic rod antenna according to the embodiment of the present invention.

FIG. 8 is a cross-sectional view of the rod coupling portion at the end of the assembly of the antenna element 10. If, as described above, the smaller-diameter rod Ra is pulled strongly outside the larger-diameter rod Rb when the film strip 31 stops, one rim portion of the film strip 31 in its width direction is pressed more strongly by the collar 40. The other rim portion of the film strip 31 is strongly pressed on the inside of the end-narrowed portion 70 (which is curved as shown), and the initial load is applied thereto. The film strip 31 is compressed and curved in the axial (or width) direction of the rods and both the end portions M and N of the film strip 31 are brought into contact with each other.

Figure 9:
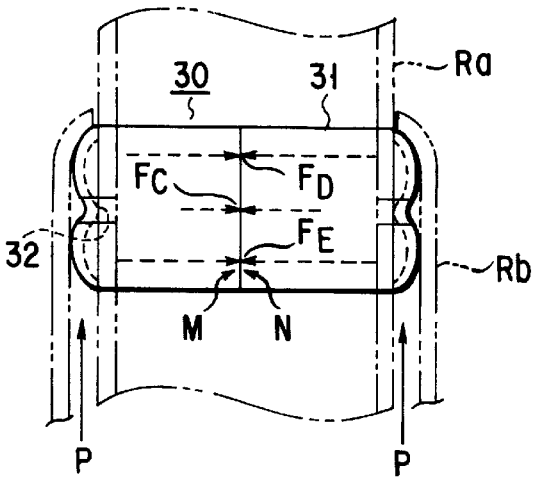
FIG. 9 is a view for explaining a process of forming the ring-shaped seal member of the telescopic rod antenna by compression and deformation.

FIG. 9 is a view for explaining a process of forming the ring-shaped seal member 30 by performing a compression deformation operation. Since the outer periphery of the film strip 31, which is rolled like a ring and inserted into the larger-diameter rod Rb, is surrounded with the inner surface of the larger-diameter rod Rb, the strip 31 is prevented from being enlarged and deformed outside. It is also prevented from being reduced and deformed inside by the outer surface of the smaller-diameter rod Ra inserted into the film strip 31.

For this reason, if the film strip 31 is compressed in the axial direction of the rod as indicated by arrows P, two regions into which the strip 31 is divided by the projecting portion (wavy curved portion) 32, are curved and deformed in the width direction. Since there are no other things for absorbing the compression force continuously applied to the strip 31, both end portions M and N of the film strip 31 in the longitudinal direction are compressed and brought into close contact with each other. The force applied to the contact face between the end portions M and N is influenced by variations in measurements in the longitudinal direction due to the curvature of the film strip 41 in the width direction. As the force is represented as the length of a broken line in FIG. 9, force $F_D$ and force $F_E$ applied to the vicinities of both peripheries, are relatively greater than force $F_C$ applied to the central part of the contact face between the end portions M and N. In this case, however, no gap occurs at the central part of the contact face, and the end portions M and N adhesively contact each other, with the result that the ring-shaped seal member 30 can be formed like an almost complete ring.

Figure 10:
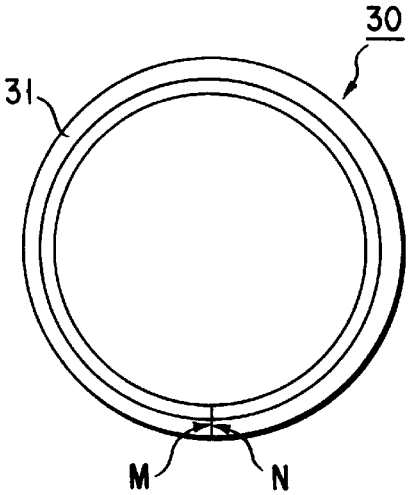
FIG. 10 is a plan view of the constitution of the ring-shaped seal member of the telescopic rod antenna according to the embodiment of the present invention.
Figure 11:
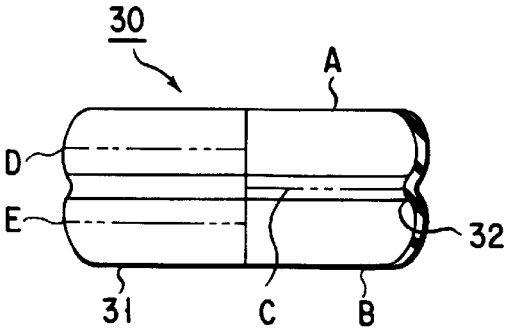
FIG. 11 is a right-hand cutaway view of the constitution of the ring-shaped seal member of the telescopic rod antenna according to the embodiment of the present invention.
Figure 14:
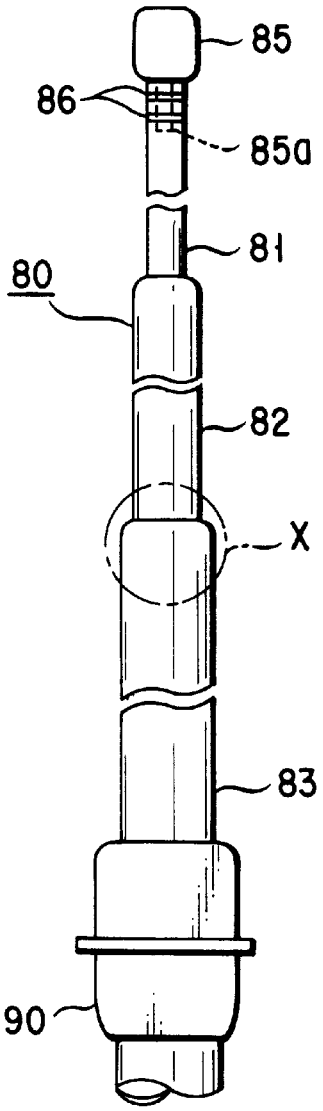
FIG. 14 (PRIOR ART)
FIG. 14 is a side view schematically showing the constitution of a prior art telescopic rod antenna.
Figure 15:
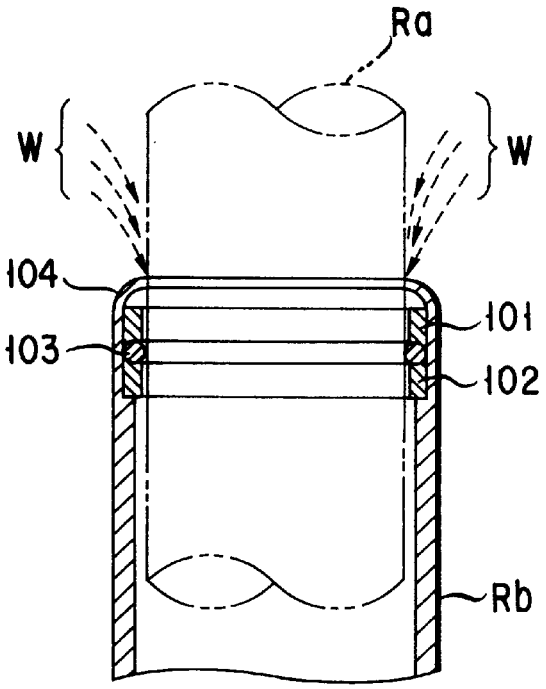
FIG. 15 (PRIOR ART)
FIG. 15 is an enlarged view of a rod coupling portion of the prior art telescopic rod antenna shown in FIG. 14.
Figure 16:
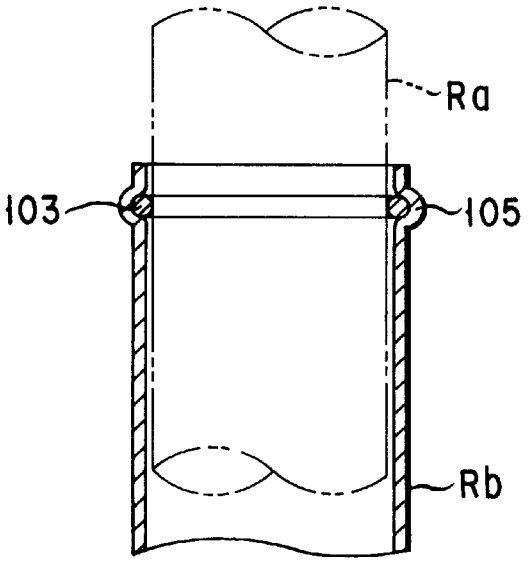
FIG. 16 (PRIOR ART)
FIG. 16 is an enlarged view of a rod coupling portion of another prior art telescopic rod antenna.

FIG. 10 is a plan view of the ring-shaped seal member 30 obtained by the compression deformation operation, and FIG. 11 is a right-hand cutaway side view thereof.

As shown in FIGS. 10 and 11, the film strip 31 of the member 30 is curved in its width direction so as to form two ridges in two regions into which the strip 31 is divided by the projecting portion 32 formed along the centerline of the strip 31 in its longitudinal direction. Both the end portions M and N of the film strip 31 are brought into close contact with each other to obtain the almost completely ringed seal member 30. Thus, five ring-shaped contact portions A to E are formed on both sides of the seal member 30 in a well-balanced fashion and adhered to the outer surface of the smaller-diameter rod Ra and the inner surface of the larger-diameter rod Rb at virtually uniform pressure.

More specifically, the contact portions A and B formed on both the rims of the film strip 31 and the contact portion C (projecting portion 32) formed along the centerline on the inside of the film strip 31 in its longitudinal direction, are adhered to the outer surface of the smaller-diameter rod Ra at a predetermined pressure. The contact portions D and E each formed along the centerline on the outside of its corresponding one of the two ridged regions of the film strip 31, are placed into contact with the inner surface of the larger-diameter rod Rb.

As a result, a gap between the outer surface of the smaller-diameter rod Ra and the inner surface of the larger-diameter rod Rb are fluid-tightly sealed by the contact portions A to E several times. It is thus possible to reliably prevent rainwater or the like from soaking into the rods through a joint between the smaller-diameter rod Ra and the larger-diameter rod Rb.

The relative positions of both the rods Ra and Rb are fixed very stably by the great compression of the holding spring 50. Therefore, even though a great vibration is externally applied to the antenna element 10, the smaller-diameter rod Ra does not fall into the larger-diameter rod Rb due to a load of the rod or the like, as indicated by the broken-line arrow in FIG. 8. Therefore, as shown in FIG. 8, even though the smaller-diameter rod Ra is pulled in the direction of the solid-line arrow and the film strip 31 is compressed in the axial (width) direction of the rods and then the pulling force is released, the deformation of the film strip 31 or the shape of the seal member 30 is maintained continuously.

Since, as described above, the relative positions of the smaller- and larger-diameter rods Ra and Rb are stably fixed by the compression of the holding spring 50, the compression/deformation state of the ring-shaped seal member 30 is maintained, and the ring-shaped contact portions A to E are adhered to the outer surface of the smaller-diameter rod Ra and the inner surface of the larger-diameter rod Rb at a predetermined pressure.

In the foregoing embodiment of the present invention, when the smaller-diameter rod Ra is pulled up from the larger-diameter rod Rb (in the direction of the solid-line arrow in FIG. 8), i.e., when the antenna element 10 is extended (used), the gap between the rods Ra and Rb is sealed fluid-tightly several times by the five ring-shaped contact portions A to E of the ring-shaped seal member 30. Consequently, water can be prevented very satisfactorily from soaking into the rods from a gap between the outer surface of the smaller-diameter rod Ra and the end-narrowed portion 70.

The ring-shaped seal member 30, which is curved to make their contact portions A to E contact the outer surface of the smaller-diameter rod Ra and the inner surface of the larger-diameter rod Rb, is self-maintained as it is by the friction due to its own repulsion. If, therefore, the smaller-diameter rod Ra is pulled into the larger-diameter rod Rb, as indicated by the broken-line arrow in FIG. 8, to retract the antenna element 10 and the tip portion 50*b* of the holding spring 50 is separated from the collar 40, the ring-shaped seal member 30 is not returned at once to the original, ring-shaped film 31 as shown in FIG. 6. In other words, even though the compression is released, the curved film strip 31 is slightly restored and its curved state is maintained as it is. Consequently, even when the antenna element is retracted (not used), the waterproof effect is produced sufficiently.

What is to be noted in particular is that the above-described operations for curving the ring-shaped seal member 30 and bringing its both ends into contact with each other are repeatedly performed whenever the antenna element 10 is extended or when the smaller-diameter rod Ra is pulled out of the larger-diameter rod Rb. Even though the rods are varied in diameter due to their use for a long time, the fluid-tightness following the variations is secured. The waterproof effect is maintained stably for a long period of time.

Since any special cutting processing hardly need be applied to each of the rods, they are easy to manufacture. Since, moreover, the film strip 31 has only to be shaped like a ring and inserted into each of the rods, it can easily be applied to a stainless steel rod as well as a brass rod without causing any problem. The film strip 31 is inexpensive and its cost can be reduced to about 1/30 of the cost of a conventional waterproof member which is shaped like a ring in advance.

(Modifications)

Figure 12:
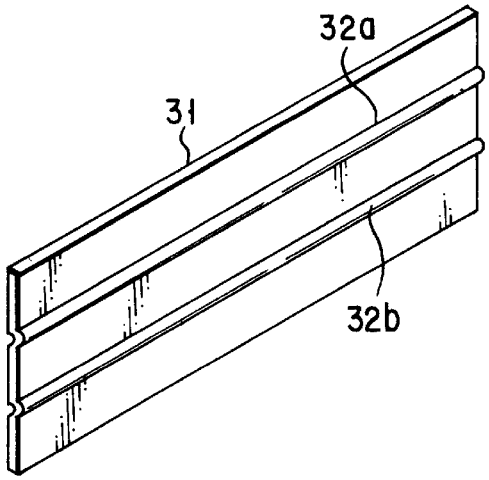
FIG. 12 is a perspective view showing a modification to a film strip for constituting the ring-shaped seal member of the telescopic rod antenna according to the embodiment of the present invention.

The telescopic rod antenna according to the above embodiment can be modified as follows:

(1) As illustrated in FIG. 12, a ring-shaped seal member is constituted of a thermoplastic resin film strip 31 having a plurality of (e.g., two) projecting portions 32*a*, 32*b*, . . . of wavy curved portions.

Figure 13:
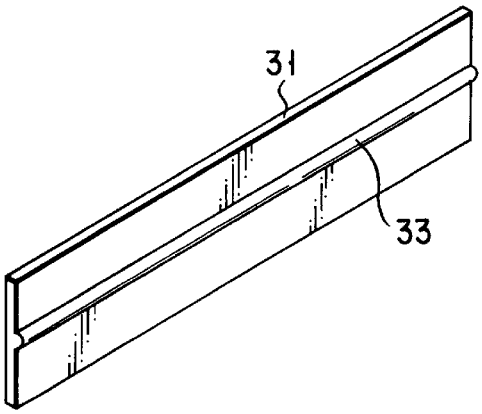
FIG. 13 is a perspective view showing another modification to a film strip for constituting the ring-shaped seal member of the telescopic rod antenna according to the embodiment of the present invention.

(2) As shown in FIG. 13, a ring-shaped seal member is constituted of a thermoplastic resin film strip 31 having a projecting portion 33 which is formed like a mountain on one side thereof.

(3) A means for preventing the collar 40 from being retreated toward the distal end opening of the larger-diameter rod Rb after the initial load is applied to the film strip 31, is added.

(4) Since the collar 40 is not always necessary, it is deleted from the rod.

(Summary of the Embodiment and Modifications)

[1] A telescopic rod antenna as described in the above embodiment, comprises an antenna element 10 including a plurality of rods 11 to 14 slidably coupled to each other, the plurality of rods having different diameters and each being formed of a conductive tube member, and a ring-shaped seal member 30 provided in a ring-shaped gap V in a joint between a smaller-diameter rod Ra and a larger-diameter rod Rb of the antenna element 10, for preventing water from soaking into the rods from outside.

The ring-shaped seal member 30 is obtained by shaping a thermoplastic resin film strip 31 like a ring, the film strip 31 having at least one projecting portion 32 along a longitudinal direction thereof, and compressing and inserting a ring-shaped film 31 into the ring-shaped gap V, adhering a plurality of ring-shaped contact portions A to E, formed along a longitudinal direction on both sides of the ring-shaped film 31, to an inner surface of the larger-diameter rod Rb and an outer surface of the smaller-diameter rod Ra at a predetermined pressure while the projecting portion 32 of the film strip 31 serves as a basic contact portion, and fluid-tightly sealing a gap V between the outer surface of the smaller-diameter rod and the inner surface of the larger-diameter rod.

[2] In the telescopic rod antenna described in item [1], the thermoplastic resin is ethylene tetrafluoride resin.

[3] In the telescopic rod antenna described in item [1], the ring-shaped seal member 30 is inserted into the ring-shaped gap V such that a single projecting portion 32, which is a wavy curved portion formed along a centerline of the film strip 31 in its longitudinal direction, contacts the outer surface of the smaller-diameter rod Ra.

[4] A telescopic rod antenna as described in the above embodiment, comprises an antenna element 10 including a plurality of rods 11 to 14 slidably coupled to each other, the plurality of rods having different diameters and each being formed of a conductive tube member, a top portion 15 provided at the tip portion of the smallest-diameter rod 11 of the antenna element 10 and including both a short cylinder member 15*a*, which is fitted to the outer periphery of a small-diameter portion 11*a* formed in advance at the tip portion of the smallest-diameter rod 11 and a stopper member 15*c* inserted and fixed into an open end 15*b* of a hollow of the short cylinder member 15*a* such that the open end 15*b* is sealed at the tip portion of the smallest-diameter rod 11, and a ring-shaped seal member 30 provided in a ring-shaped gap V in a joint between a smaller-diameter rod Ra and a larger-diameter rod Rb of the antenna element 10, for preventing water from soaking into the rods from outside.

The ring-shaped seal member 30 is obtained by shaping a thermoplastic resin film strip 31 like a ring, the film strip 31 having at least one projecting portion 32 along a longitudinal direction thereof, and compressing and inserting a ring-shaped film 31 into the ring-shaped gap V, adhering a plurality of ring-shaped contact portions A to E, formed along a longitudinal direction on both sides of the ring-shaped film 31, to an inner surface of the larger-diameter rod Rb and an outer surface of the smaller-diameter rod Ra at a predetermined pressure while the projecting portion 32 of the film strip 31 serves as a basic contact portion, and fluid-tightly sealing a gap V between the outer surface of the smaller-diameter rod and the inner surface of the larger-diameter rod.

[5] In the telescopic rod antenna described in item [4], the stopper member 15*c* of the top portion 15 is made of resin and pressed into the open end 15*b* of the hollow of the short cylinder member 15*a* so as to seal the open end 15*b*.

[6] A method for manufacturing a telescopic rod antenna as described in the above embodiment, comprises a step of obtaining a thermoplastic resin film strip 31 having a preset measurement on which at least one projecting portion 32 is formed along a longitudinal direction of the film strip 31, a step of shaping the film strip 31 like a ring and inserting a ring-shaped film 31 into a larger-diameter rod Rb from an opening at a distal end portion thereof, a step of inserting a smaller-diameter rod Ra into the larger-diameter rod Rb from the opening of the distal end portion of the larger-diameter rod Rb, and a step of pulling the smaller-diameter rod Ra out of an opening at a tip portion of the larger-diameter rod Rb and compressing the film strip 31 in a ring-shaped gap V in a joint between the smaller-diameter rod Ra and the larger-diameter rod Rb in an axial direction of the rods.

The film strip 31 is curved in its width direction in a plurality of regions into which the film strip 31 is divided by the projecting portion 32, both end portions M and N of the film strip 31 are brought into contact with each other, and a plurality of ring-shaped contact portions A to E, which are formed along a longitudinal direction on both sides of the film strip 31, are adhered to an inner surface of the larger-diameter rod Rb and an outer surface of the smaller-diameter rod Ra at a predetermined pressure while the projecting portion 32 serves as a basic contact portion.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A telescopic rod antenna comprising:

an antenna element including a plurality of rods slidably coupled to each other, the plurality of rods having different diameters and each being formed of a conductive tube member;

a holding spring which is fixed to a distal end portion of a smaller-diameter rod of the antenna element and part of which is pressed on an inner surface of a larger-diameter rod the holding spring serving as a rod coupling element; and a ring-shaped seal member provided in a ring-shaped gap in a joint between the smaller-diameter rod having the holding spring at the distal end portion thereof and the larger-diameter rod, for preventing water from soaking into the rods from outside, wherein the ring-shaped seal member is obtained by shaping a thermoplastic resin film strip like a ring, the film strip having at least one projecting portion along a longitudinal direction thereof, and compressing and inserting the ring-shaped film into the ring-shaped gap, adhering a plurality of ring-shaped contact portions, formed along a longitudinal direction on both sides of the ring-shaped film, to an inner surface of the larger-diameter rod and an outer surface of the smaller-diameter rod at a predetermined pressure while the projecting portion of the film strip serves as a basic contact portion, and fluid-tightly sealing a gap between the outer surface of the smaller-diameter rod and the inner surface of the larger-diameter rod.

2. The telescopic rod antenna according to claim 1, wherein the thermoplastic resin is ethylene tetrafluoride resin.

3. The telescopic rod antenna according to claim 1, wherein the ring-shaped seal member is inserted into the ring-shaped gap such that a single projecting portion, which is a wavy curved portion formed along a centerline of the film strip in a longitudinal direction thereof, contacts the outer surface of the smaller-diameter rod.

4. A telescopic rod antenna comprising:

an antenna element including a plurality of rods slidably coupled to each other, the plurality of rods having different diameters and each being formed of a conductive tube member;

a holding spring which is fixed to a distal end portion of a smaller-diameter rod of the antenna element and part of which is pressed on an inner surface of a larger-diameter rod, the holding spring serving as a rod coupling element;

a top portion provided at a tip portion of a smallest-diameter rod of the antenna element, and including both a short cylinder member, which is fitted to the outer periphery of a small-diameter portion formed in advance at the tip portion of the smallest-diameter rod and a stopper member inserted and fixed into an open end of a hollow of the short cylinder member such that the open end is sealed at the tip portion of the smallest-portion rod; and a ring-shaped seal member provided in a ring-shaped gap in a joint between the smaller-diameter rod having the holding spring at the distal end portion thereof and the larger-diameter rod, for preventing water from soaking into the rods from the outside, wherein the ring-shaped seal member is obtained by shaping a thermoplastic resin film strip like a ring, the film strip having at least one projecting portion along a longitudinal direction thereof, and compressing and inserting the ring-shaped film into the ring-shaped gap, adhering a plurality of ring-shaped contact portions, formed along a longitudinal direction on both sides of the ring-shaped film, to an inner surface of the larger-diameter rod and an outer surface of the smaller-diameter rod at a predetermined pressure while the projecting portion of the film strip serves as a basic contact portion, and fluid-tightly sealing a gap between the outer surface of the smaller-diameter rod and the inner surface of the larger-diameter rod.

5. The telescopic rod antenna according to claim 4, wherein the stopper member of the top portion is made of resin and pressed into the open end of the hollow of the short cylinder member so as to seal the open end.

6. A method for manufacturing a telescopic rod antenna, comprising:

a step of obtaining a thermoplastic resin film strip having a preset measurement, on which at least one projecting portion is formed along a longitudinal direction of the film strip;

a step of shaping the film strip like a ring and inserting the ring-shaped film into a larger-diameter rod from an opening at a distal end portion thereof;

a step of inserting a smaller-diameter rod, to which a holding spring serving as a rod coupling element is fixed at a distal end portion thereof, into the larger-diameter rod from the opening of the distal end portion of the larger-diameter rod; and a step of pulling the smaller-diameter rod out of an opening at a tip portion of the larger-diameter rod and compressing the film strip in a ring-shaped gap in a joint between the smaller-diameter rod and the larger-diameter rod in an axial direction of the rods;

wherein the film strip is curved in a width direction thereof in a plurality of regions into which the film strip is divided by the projecting portion, both end portions of the film strip are brought into contact with each other, and a plurality of ring-shaped contact portions, which are formed among a longitudinal direction on both sides of the film strip, are adhered to an inner surface of the larger-diameter rod and an outer surface of the smaller-diameter rod at a predetermined pressure while the projecting portion serves as a basic contact portion.

* * * * *